US008541674B2

(12) United States Patent
Kamensky

(10) Patent No.: US 8,541,674 B2
(45) Date of Patent: Sep. 24, 2013

(54) SUPPORT BRIDGE

(76) Inventor: Jody M. Kamensky, Chesterland, OH (US)

( * ) Notice: Subject to any disclaimer, the term of this patent is extended or adjusted under 35 U.S.C. 154(b) by 208 days.

(21) Appl. No.: 12/975,525

(22) Filed: Dec. 22, 2010

(65) Prior Publication Data

US 2012/0011985 A1 Jan. 19, 2012

Related U.S. Application Data

(60) Provisional application No. 61/399,482, filed on Jul. 13, 2010.

(51) Int. Cl.
*G10D 3/00* (2006.01)

(52) U.S. Cl.
USPC ..... 84/327

(58) Field of Classification Search
USPC ..... 84/327, 329, 421
See application file for complete search history.

(56) References Cited

U.S. PATENT DOCUMENTS 4,065,994 A * 1/1978 Streit ..... 84/453

* cited by examiner

*Primary Examiner* — Kimberly Lockett
(74) *Attorney, Agent, or Firm* — Anthony M. Del Zoppo, III; Driggs, Hogg, Daugherty & Del Zoppo Co., LPA

(57) ABSTRACT

A support bridge includes a support platform having a top surface and a bottom surface and a holder attached to the top surface of the support platform. The holder includes a first set of support members separated by a first gap, a first material free region, in the first support member, that provides access from outside of the first member through the first member to the first gap, and a first securing member on a surface of the first support member bounding the first material free region, and a first plug configured to physically engage the first securing member to secure a first object disposed between the first members in the first gap to the holder and the support platform.

15 Claims, 7 Drawing Sheets

SUPPORT BRIDGE

CROSS REFERENCE TO RELATED APPLICATIONS

This application claims the benefit of priority of provisional patent application Ser. No. 61/399,482, filed on Jul. 13, 2010, and entitled "MUSICAL BRIDGE," which is incorporated herein in its entirety by reference.

TECHNICAL FIELD

The following generally relates to a support bridge and is described in connection with a string instrument. However, the following is also amenable to other instruments and non-instruments.

BACKGROUND

A string instrument generally includes a body portion having longitudinal axis and an elongate neck portion having first and second opposing ends. One of the ends of the neck is attached to the body, and the neck extends along the longitudinal axis. A headstock is attached to the other end of the neck, and a fretboard is attached to the neck. A bridge is attached to the body along the longitudinal axis, and a set of strings are strung along the longitudinal axis between the headstock and the bridge. As shown in FIG. 1, with a guitar 102, a strap 104 is attached to the ends of the body 106 and placed over a shoulder 108 of a standing player 110, supporting the guitar 102 in position. Unfortunately, if the player 110 is not standing (e.g., lying down, in a chair, etc.), the strap generally cannot be used to support the guitar in position.

SUMMARY OF THE INVENTION

Aspects of the application address the above matters, and others.

In one aspect, a support bridge includes a support platform having a top surface and a bottom surface and a holder attached to the top surface of the support platform. The holder includes a first set of support members separated by a first gap, a first material free region, in the first support member, that provides access from outside of the first member through the first member to the first gap, and a first securing member on a surface of the first support member bounding the first material free region, and a first plug configured to physically engage the first securing member to secure a first object disposed between the first members in the first gap to the holder and the support platform.

In another aspect, a method includes attaching a holder of a first side of a support bridge to a first object and attaching a support bracket of a second side of the support bridge to a second object. The first and second sides are opposing sides. The first object is a musical instrument which is played by a person while the support bridge is attached to the second object In yet another aspect, an apparatus for supporting a musical instrument in connection with a chair or bed includes a support platform having a top surface and a bottom opposing surface, a holder attached to the top surface of the support platform, the holder configured to securely hold the musical instrument, and a support bracket attached to the bottom surface of the support platform, the support bracket configured to securely attached to an arm of the chair or a rail of the bed.

Those skilled in the art will recognize still other aspects of the present application upon reading and understanding the attached description.

DETAILED DESCRIPTION

The following generally relates to string instruments such as a guitar, violin, cello, viola, bass guitar, mandolin, banjo, harp, and/or other string instruments, and/or non string instruments, and/or non-instruments. However, for brevity and clarity, the following is described in connection with a guitar.

Figure 1:
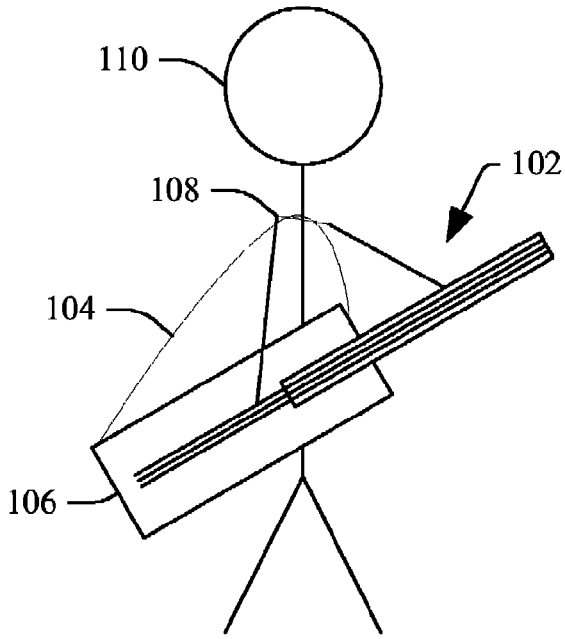
FIGURE 1 (PRIOR ART)
FIG. 1 schematically illustrates prior art.
Figure 2:
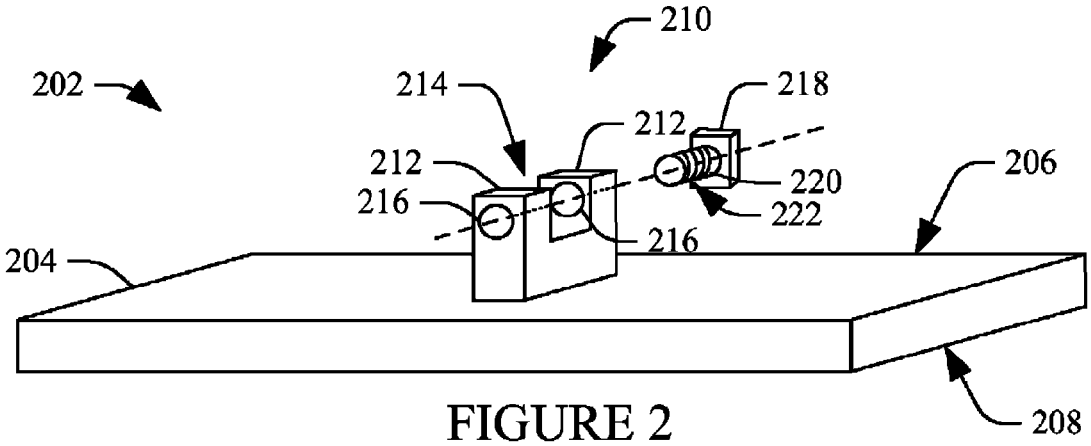
FIG. 2 schematically illustrates a support bridge.

Initially referring to FIG. 2, a support bridge 202 includes a support platform 204, having top and bottom major surfaces 206 and 208, and a holder 210, which can be fixedly or removable attached to the support platform 204, for example, on the first major surface 206 as shown in the illustrated embodiment. In another embodiment, the holder 210 is part of the support platform 204.

The holder 210 includes first and second support members 212 separated by a gap 214 therebetween. Material free regions 216 in the support members 212 provide access from outside of the members 212 through the members 212 to the gap 214. In the illustrated embodiment, support members 212 include securing members (not visible) on the surfaces bounding the material free regions 216 within the members 212. In one instance, the securing members include threads such as threads similar to threads of a screw.

A plug 218 has a protrusion 220 with complementary securing members 222 (threads in this non-limiting example) that are configured to engage the securing members in the material free regions 216. Where the securing members are threads, and the threads can be securely engaged. In the illustrated embodiment, one plug 218 is shown, however, a different plug 218 can be used for each of the two illustrated material free regions 216. Alternatively, in another embodiment, the holder 210 includes only one of the material free regions 216.

Figure 3:
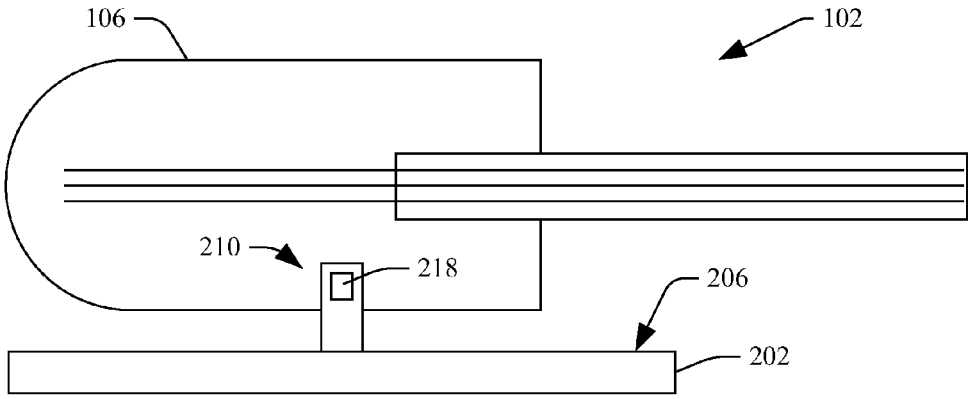
FIG. 3 schematically illustrates the support bridge holder a guitar horizontally.
Figure 4A:
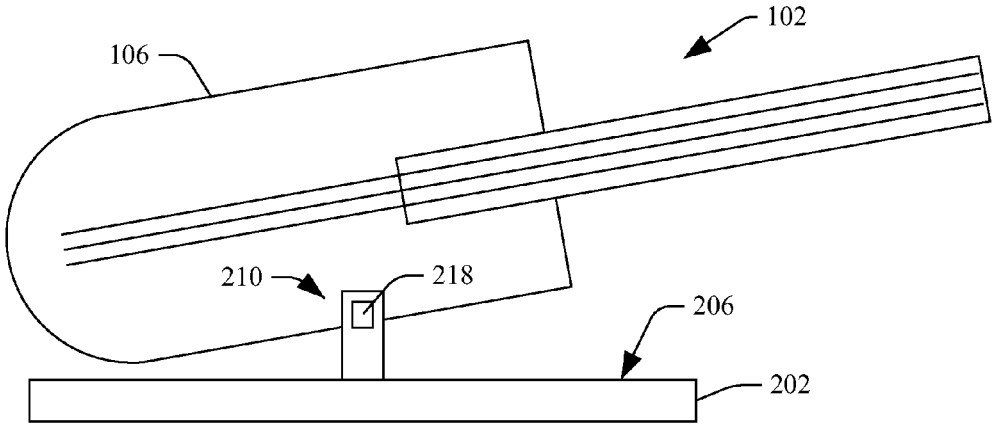
FIG. 4A schematically illustrates the support bridge holder a guitar at an angle.
Figure 4B:
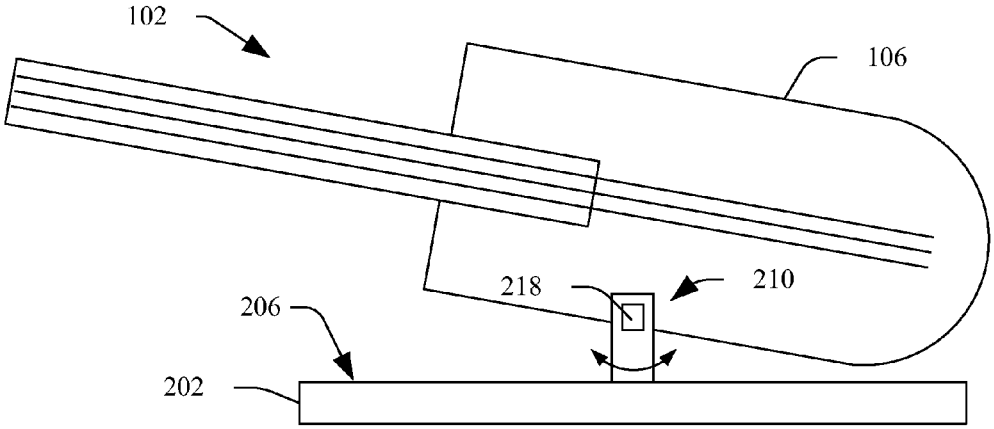
FIG. 4B schematically illustrates the support bridge holder a guitar at an angle and rotated 180 degrees with respect to FIG. 4.

As shown in FIGS. 3, 4A and 4B, the body 106 of the guitar 102 (or other musical or non-musical instrument) can be placed in the gap 214 and secured to the bridge 202 via the plugs 218. That is, the body 106 can be placed in the gap 214, and the plugs 218 can be screwed into the material free regions 216 until the plugs 218 physically contact and apply a force to the body 106 to hold the body 106.

In FIG. 3, the guitar 102 is inserted generally horizontally in the holder 210 with respect to the top surface 206, and, in FIGS. 4A and 4B, the guitar 102 is inserted in the holder 210 at non-zero angle with respect to the respect to the top surface 206. As shown in FIGS. 4A and 4B, the holder 210 may optionally be configured so that it can rotate about an axis perpendicular to the top 206 of the bridge 202. As such, the guitar 102 can be rotated (e.g., 360 degrees) about the axis with the guitar 102 secured in the holder 210. The illustrated guitar 102 is rotated 180 degrees.

Figure 5:
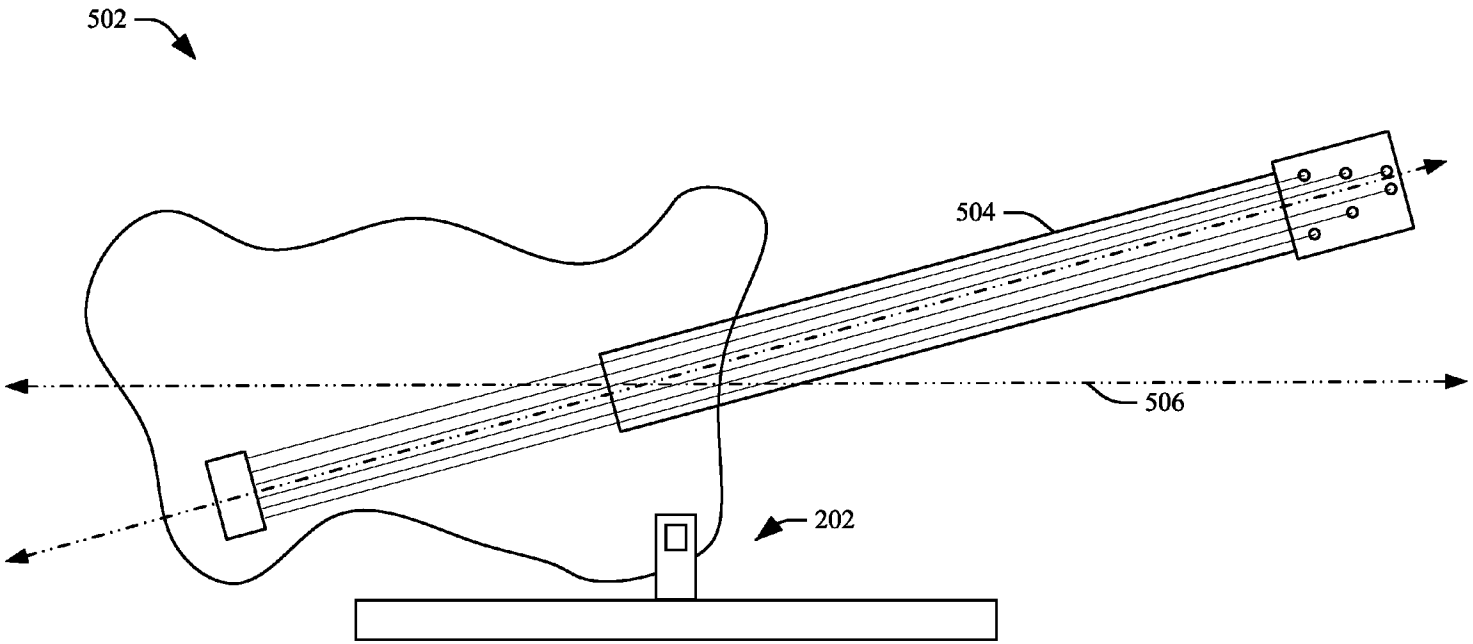
FIG. 5 schematically illustrates the support bridge holder a guitar having a neck positioned at an angle with respect to a longitudinal axis of the guitar.

FIG. 5 illustrates an example embodiment in which a guitar 502 includes a neck 504 that is securely or adjustably positioned at an angle with respect to a longitudinal axis 506 running along the long axis of the guitar 502. An example of such a guitar is described in application Ser. No. 12/491,955, filed on Jun. 25, 2009, and entitled "STRING INSTRUMENT," which is incorporated herein by reference in its entirety.

Figure 6:
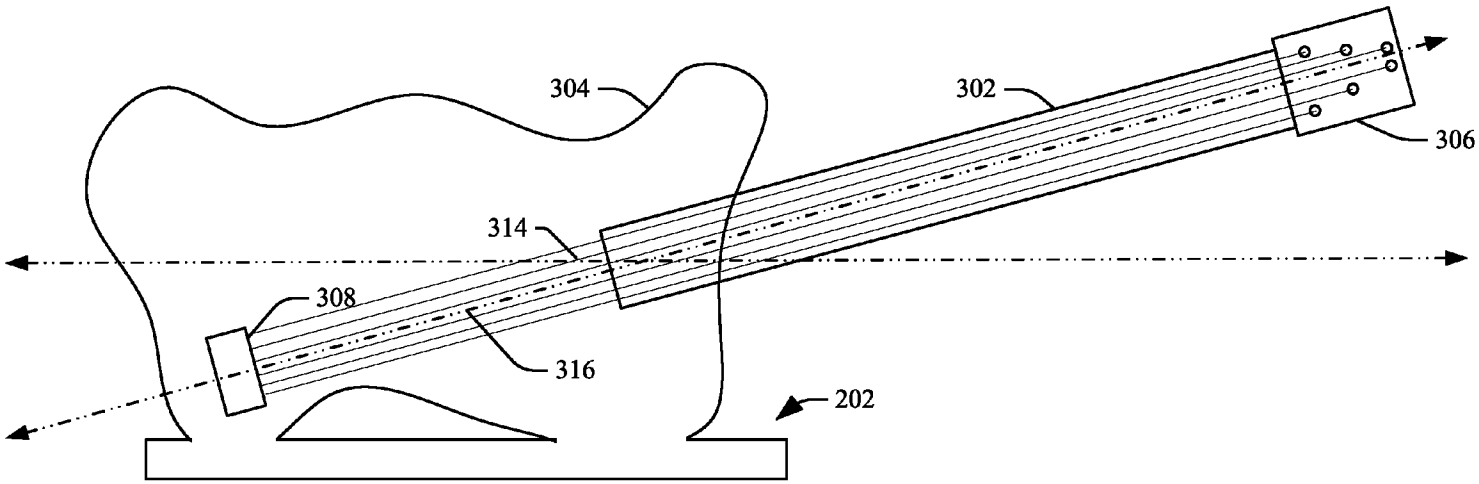
FIG. 6 schematically illustrates a guitar in which the support bridge is part of a body of the guitar.

FIG. 6 illustrates an example embodiment in which the guitar 502 and the support bridge 202 form a single unitary instrument in which the support bridge 202 is part of the body of the guitar 502 or vice versa. In another example, the guitar 102 is part of the support bridge 202. In another example, another instrument or non-instrument is part of the support bridge.

Figure 7:
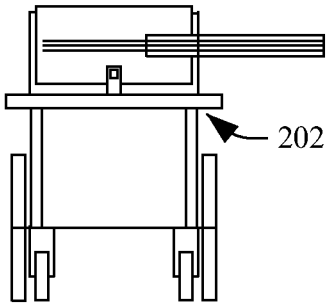
FIGS. 7 and 8 schematically illustrate the support bridge holding a guitar in connection a wheel chair.
Figure 8:
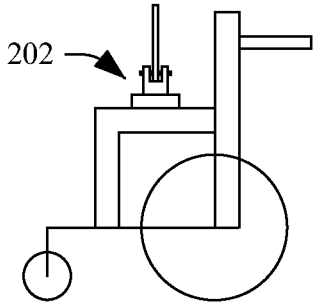
Figure 9:
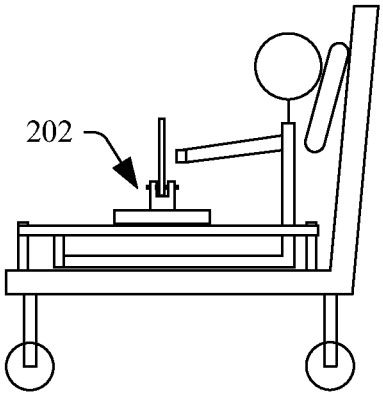
FIG. 9 schematically illustrates the support bridge holding a guitar in connection with a bed.
Figure 10:
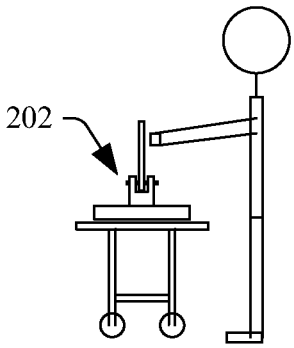
FIG. 10 schematically illustrates the support bridge holding a guitar in connection a stand.

With respect to FIGS. 2-6, the support bridge 202 supports the guitar 102 or 502, and can be placed across arms of a wheel (or other) chair as shown in FIGS. 7 and 8, the lap of a person in a bed or the rails of the bed (FIG. 9), on a cart in connection with a standing person (FIG. 10), and/or otherwise used to support the guitar while a person plays the guitar.

With respect to FIGS. 2-10 and/or other figures herein, it is to be appreciated that the size and/or the shape of the support bridge 202 and/or the components thereof (e.g., the holder 210, etc.) are provided for explanatory purposes and are not limiting. As such, in other embodiments, the size and the shape of the support bridge 202 and/or the components thereof (e.g., the holder 210, etc.) can be different.

Figure 11:
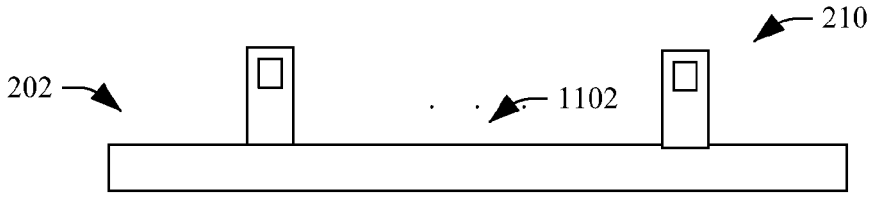
FIG. 11 schematically illustrates the support bridge having multiple holders.

FIG. 11 illustrates an embodiment in which the support bridge 202 includes N holders 210, wherein N is an integer number equal to or greater than two. In this embodiment, the holders 210 are symmetrically disposed about a center region 1102 of the support bridge 202. In other embodiments, the holders 210 are asymmetrically disposed about the center region 1102.

Figure 12:
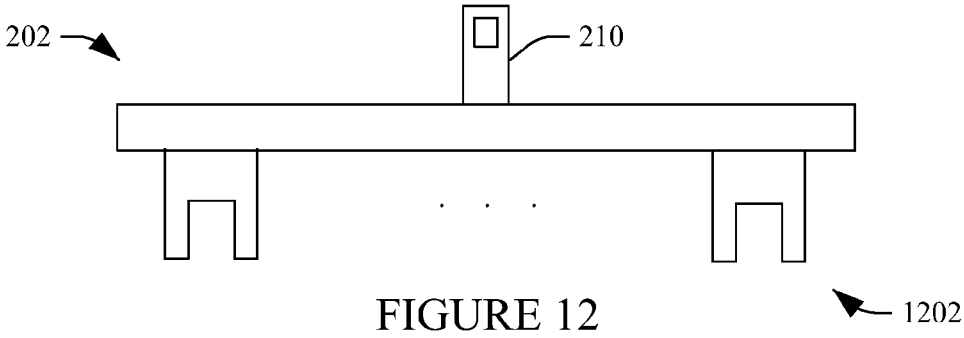
FIG. 12 schematically illustrates the support bridge having multiple support brackets.
Figure 13:
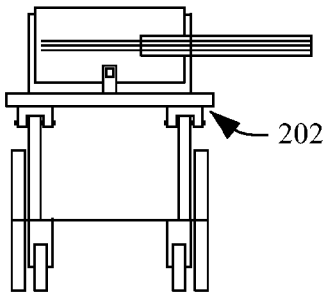
FIGS. 13 and 14 schematically illustrate the support bridge attached to a wheel chair.
Figure 14:
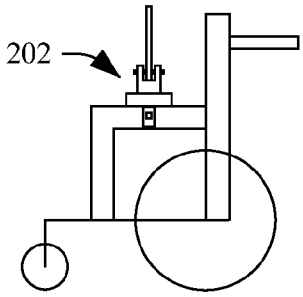

FIG. 12 illustrates an embodiment in which the support bridge 202 includes the holder 210 on the top surface 206 (as described above) and one or more support brackets 1202 on the bottom surface 208. In the illustrated embodiment, the support bracket 1202 is substantially similar to the holder 202, but is us used to secure the bridge 202, for example, to the arms of the chair in FIGS. 7 and 8 (as shown in FIGS. 13 and 14), the rail of the bed in FIG. 8, and stand in FIG. 10, etc.

That is, the support bracket 1202 includes one or more support members, material free regions, securing members, etc. Also like the holder 210, the support bracket 1202 may optionally be configured so that it can rotate. However, in the example, the support bracket 1202 rotates about an axis perpendicular to the bottom 208 of the bridge 202.

Although the support bracket 1202 is shown as a single member, it is to be appreciated that the support bracket 1202 may include a plurality of members fixedly attached to each other (e.g., a predetermined angles) and/or moveably attached to each other (e.g., at joints or elbows) via bearings or the like and configured to move (e.g., pivot, rotate, etc.) with respect to each other. This allows for various degrees of freedom to position the bracket 1202 to attach to members that do not run parallel to the bottom surface 208.

Figure 15:
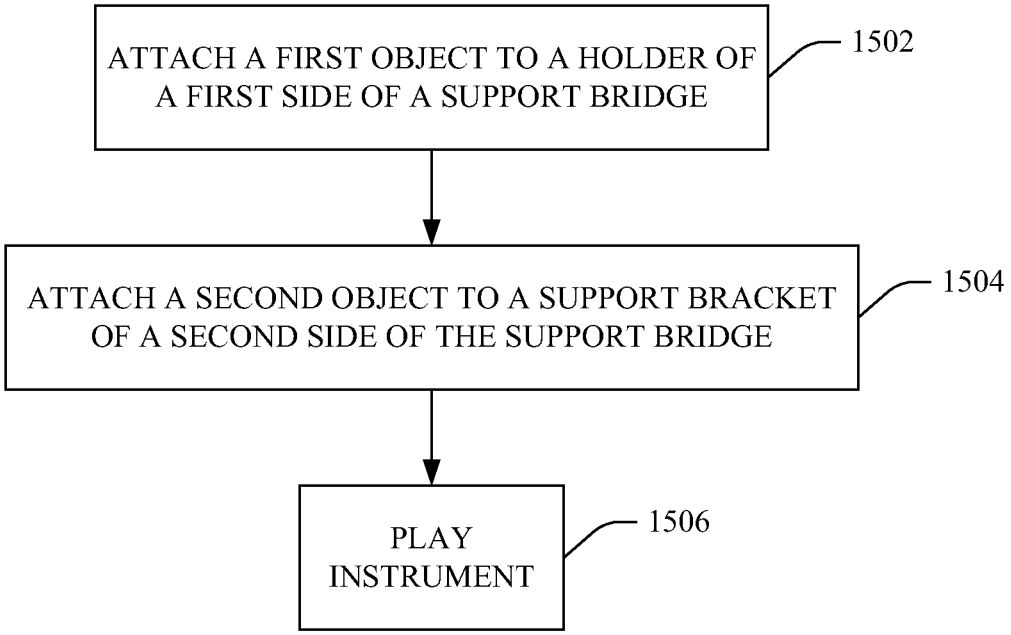
FIG. 15 illustrates a method.

FIG. 15 illustrates a method.

It is to be appreciated that the ordering of the acts is not-limiting. As such, other ordering is contemplated herein. In addition, one or more of the acts may be omitted and/or one or more acts may be added.

At 1502, a musical or other instrument is attached to the support bridge 202.

At 1504, the support bridge 202 is set on and optionally secured to a chair, a bed, a stand, and/or other object.

At 1506, a person plays the musical or other instrument.

It is to be appreciated that the support bridge 202 can be utilized, for example, by a physically challenged person or child confined to a bed or wheel chair, but not limited thereto, to facilitate the person or child play a musical instrument and/or use another instrument. Generally, the support bridge 202 can be used to support, hold and/or position the musical instrument in a way that would allow them to play the instrument. This support bridge 202 may be a separate fixture from the instrument or designed into the instrument or a combination of both and possibly designing the complete instrument to facilitate the playing of an instrument by the physically challenged. This final apparatus can also be completely or partially customizable and adaptable to many different situations.

Although the holder 210 and the support bracket 1202 are shown as generally "U"-shape devices, other shapes are contemplated herein. For example, in another embodiment, the bracket 1202 includes multiple sections and forms a generally closed ring around the wheel chair arm, the bed rail, etc. In another example, at least one of the holder 210 or the bracket 1202 could be "C" or "V" shaped.

The application has been described with reference to various embodiments. Modifications and alterations will occur to others upon reading the application. It is intended that the invention be construed as including all such modifications and alterations, including insofar as they come within the scope of the appended claims and the equivalents thereof.

What is claimed is:

1. A support bridge, comprising:

a support platform having a top surface and a bottom surface; and a holder attached to the top surface of the support platform, the holder, including:

a first set of support members separated by a first gap;

a first material free region, in the first support member, that provides access from outside of the first member through the first member to the first gap;

a first securing member on a surface of the first support member bounding the first material free region; and a first plug configured to physically engage the first securing member to secure a first object disposed between the first members in the first gap to the holder and the support platform.

2. The support bridge of claim 1, further comprising:

a support bracket on the bottom surface of the support platform, the support bracket including:

second support members separated by a second gap;

a second material free region, in the second support members, that provides access from outside of the second member through the second member to the second gap;

a second securing member on a surface of the second support member bounding the second material free region; and a second plug configured to physically engage the second securing member to secure a second object disposed between the second members in the second gap to the holder and the support platform.

3. The support bridge of claim 2, wherein the first object is one of a guitar, a violin, a cello, a viola, a bass, a mandolin, or a banjo.

4. The support bridge of claim 2, wherein the first object is a non-musical instrument.

5. The support bridge of claim 3, wherein the second object is an arm of a wheel chair or a rail of a bed.

6. The support bridge of claim 5, wherein the support bracket is stationarily attached to the bottom surface.

7. The support bridge of claim 6, wherein the support bracket is rotationally or pivotally attached to the bottom surface.

8. The support bridge of claim 7, wherein the holder is stationarily attached to the top surface.

9. The support bridge of claim 8, wherein the holder is rotationally or pivotally attached to the top surface.

10. The support bridge of claim 9, wherein the first object is a musical instrument which is played by a person while the bridge is attached to the second object.

11. The support bridge of claim 10, wherein the first object is a separate component removeably held to the support bridge by the holder.

12. The support bridge of claim 10, wherein the first object is a sub-portion of the support platform.

13. An apparatus for supporting a musical instrument in connection with a chair or a bed, comprising:

a support platform having a top surface and a bottom opposing surface;

a holder attached to the top surface of the support platform, the holder configured to securely hold the musical instrument; and a support bracket attached to the bottom surface of the support platform, the support bracket configured to securely attach to an arm of the chair or a rail of the bed.

14. The apparatus of claim 13, wherein the holder is adjustable to position the musical instrument in a position at which it is played by a person.

15. The apparatus of claim 13, wherein the support bracket is adjustable to attached to the arm or rail to allow the person to play the musical instrument.

* * * * *